US005424110A

United States Patent [19]

Tornero et al.

[11] Patent Number: 5,424,110

[45] Date of Patent: Jun. 13, 1995

[54] DECKING SUSPENSION FABRIC AND METHOD

[76] Inventors: Roger Tornero, 6117 Ballinger Rd., Greensboro, N.C. 27410; S. David Gray, 1710 Three Meadows Rd., Greensboro, N.C. 27408

[21] Appl. No.: 217,135

[22] Filed: Mar. 23, 1994

Related U.S. Application Data

[63] Continuation of Ser. No. 874,020, Apr. 27, 1992, abandoned.

[51] Int. Cl.[6] ..... B32B 5/12; B32B 7/00; D04B 23/08; D04B 21/00

[52] U.S. Cl. ..... 428/114; 428/167; 428/229; 428/232; 428/253; 66/195; 66/192

[58] Field of Search ..... 428/253, 229, 232, 167, 428/114; 66/190, 192, 195

[56] References Cited

U.S. PATENT DOCUMENTS

| | | | |
|---|---|---|---|
| 226,595 | 4/1880 | Chase | 66/195 |
| 3,077,947 | 2/1963 | Peebles et al. | 428/232 |
| 3,381,502 | 5/1968 | Turton | 66/192 |
| 3,775,235 | 11/1973 | Howell | 428/114 |
| 3,782,137 | 1/1974 | Hughes | 66/192 |
| 4,277,527 | 7/1981 | Duhl | 428/232 |
| 4,298,645 | 11/1981 | Obayashi et al. | 428/253 |
| 4,303,724 | 12/1981 | Sergeant et al. | 428/229 |
| 4,450,196 | 5/1984 | Kamat | 428/253 |
| 4,518,640 | 5/1985 | Wilkens | 428/253 |
| 4,615,934 | 10/1986 | Ellison | 428/253 |
| 4,722,203 | 2/1988 | Darjee | 66/190 |
| 4,856,299 | 8/1989 | Bryant | 66/202 |
| 4,980,930 | 1/1991 | Cusimano | 428/102 |
| 5,118,569 | 6/1992 | Kuroda et al. | 428/253 |
| 5,153,049 | 10/1992 | Groshens | 428/229 |

FOREIGN PATENT DOCUMENTS

| | | | |
|---|---|---|---|
| 83/00707 | 3/1983 | WIPO | 428/232 |

OTHER PUBLICATIONS

Hoechst Celanese Corporation Trevira Type 785 Polyester brochure.

*Primary Examiner*—George F. Lesmes
*Assistant Examiner*—Terrel Morris

[57] ABSTRACT

A decking suspension material and method of application to a furniture frame is provided whereby in one embodiment a fabric is knitted from a plurality of polymeric yarns and at least one of the yarns has a relatively high denier. More specifically, a non-textured polyester warp yarn is utilized having a denier of 1,000 as contrasted to the other yarns which have a denier of 150. The high denier warp yarn consists of a multifilament yarn having a tenacity of 8.8 g/d, and a filament count of 74 whereby the multifilament yarn is exposed along the bottom surface of the fabric when installed on the furniture frame to provide strength and rigidity to the decking suspension material.

20 Claims, 3 Drawing Sheets

DECKING SUSPENSION FABRIC AND METHOD

This application is a continuation of application Ser. No. 07/874,020, filed 27 Apr. 1992, now abandoned.

BACKGROUND OF THE INVENTION

1. Field of the Invention

The present invention pertains to fabrics used in furniture construction and particularly to fabrics which are utilized as decking suspension materials on furniture articles such as sofas to support seat cushions.

2. Description of the Prior Art and Objectives of the Invention

Upholstered sofas and chairs which employ individual seat cushions are conventionally constructed with a seat frame which supports the cushions generally around the cushion edges or perimeters. However, additional support of a resilient nature is needed directly under the cushion body and a variety of support mechanisms in the past have been employed such as banks of coil springs, sinuous springs which span the frame, Dymetrol® fabric (DuPont trademark) which includes a Hytrel® (DuPont trademark) monofilament yarn woven in the "fill" direction. Elastic webbings have also been used in the past as decking, but such webbing will deteriorate over an extended period due to ozone and other detrimental environmental agents.

All prior attempts at supporting sofa cushions have met with some degree of success, yet all have had shortcomings which the present invention attempts to overcome. More particularly, metal coil and sinuous springs used in the past have been expensive, unwieldy and difficult to incorporate into sofa and chair frames. Also, once incorporated such mechanisms oftentimes break, become weak over time and can puncture the decking fabric used to cover them. Fabrics such as Dymetrol® used without supporting coil springs or other mechanisms are expensive to use since they can only be purchased in a limited variety of sizes, thereby creating substantial trim waste during the furniture construction. In order to stabilize woven fabrics employing Hytrel® or other similar yarns, the fabric is heat set after production and thus the Hytrel® filaments must be coextruded with an outer filament layer, so the outer layer will melt into the woven polyester fibers of the fabric. Thus, the extrusion provides another difficult and time consuming manufacturing step, increasing the cost of the fabric.

With the aforesaid problems known, the present invention was conceived and one of its objectives is to provide a superior decking suspension material which can be used without the necessity of underlying springs, elastic webbing or other supports.

It is another objective of the present invention to provide a decking material which is relatively easy to handle and inexpensive to purchase.

It is yet another objective of the present invention to provide a decking material which is durable and which will provide the proper resiliency and feel for the user when installed.

It is still another objective of the present invention to provide a decking material which can be supplied in rolls of various lengths and widths as required for particular furniture manufacturers and upholsterers.

It is yet still another objective of the present invention to provide a decking material which, in one embodiment is formed from a knitted fabric having a high denier, high tenacity, multifilament polyester yarn incorporated therein for strength and stability.

It is a further objective of the present invention to provide a decking suspension material in another embodiment which can be formed from a variety of base fabrics or materials and which includes a high denier, high tenacity polyester yarn sewn therein in multiple parallel rows.

Various other objectives and advantages of the present invention become apparent to those skilled in the art as a more detailed presentation is set forth below.

SUMMARY OF THE INVENTION

The invention herein provides a method for applying a decking suspension material to a furniture frame such as a conventional sofa and also provides a durable, yet lightweight decking material. In one embodiment of the material a warp knit fabric is provided which includes a series of parallel ribs formed on the bottom surface by the utilization of a tenacity, high denier multifilament polyester yarn knitted therein. In another embodiment of the decking material, a base fabric such as a conventional woven polyester fabric is provided with a plurality of stitched rows of a heavy denier, high tenacity multifilament polyester fiber. The stitched rows may be for example spaced at one-quarter inch intervals and extend the length of the fabric.

The method of applying the decking material to a furniture frame comprises attaching it to one end of the outside of the frame with the ribs or sewn in polyester fibers aligned parallel to the longitudinal axis of the frame. The fabric is then manually pulled to tension the material and it is then attached to the opposite side of the frame while under tension by stapling or the like. The sides of the material are then affixed to the frame where it remains under tension and is fully supportive of cushions and provides durable, long lasting decking.

DESCRIPTION OF THE PREFERRED EMBODIMENTS

Figure 1A:
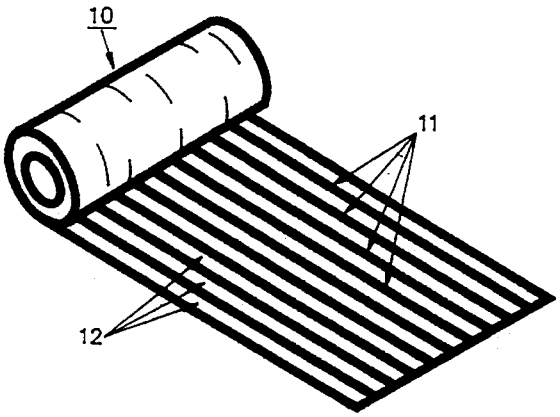
FIG. 1A represents a roll of decking suspension material of the present invention which has been manufactured on a conventional warp knitting machine.
Figure 1B:
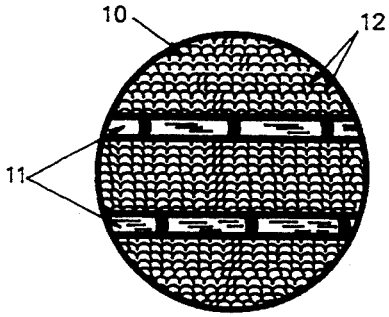
FIG. 1B demonstrates a close-up view of a section of the fabric of FIG. 1A.
Figure 1C:
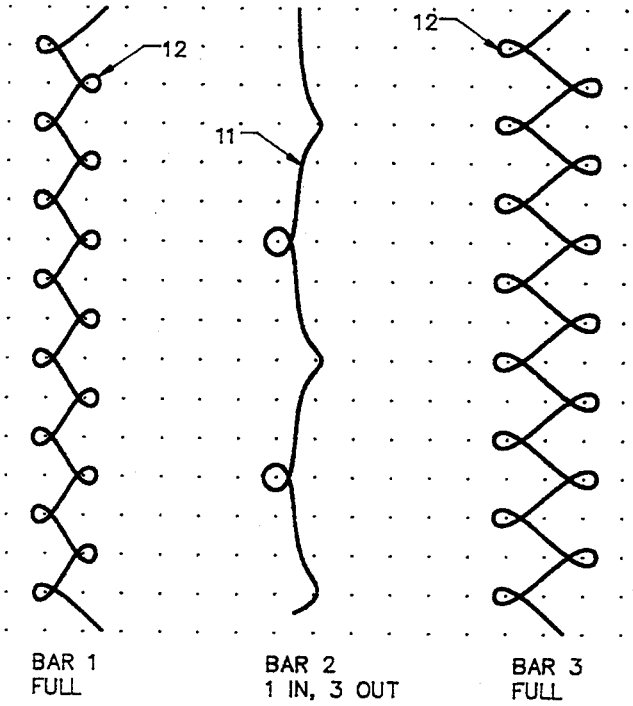
FIG. 1C pictures a stitch pattern for a warp knit machine as may be used to provide the fabric of FIG. 1A.

The present invention provides various embodiments of the decking material with the preferred embodiment shown in FIGS. 1A, 1B and 1C. As seen, a warp knit fabric is formed which includes a high tenacity, non-textured multifilament polyester yarn. The multifilament yarn has a relatively high denier of 1,000 as compared to the other yarns in the fabric which are textured and have a denier of only 150. In knitting, a conventional Raschel, 40 gauge warp knitting machine is utilized whereby bar 1 employs a full thread stitch with 150 denier textured polyester yarn as does bar 3. Bar 2 utilizes a 1-in 3-out stitch with the 1,000 denier non-textured multifilament yarn. The finished fabric as shown in FIG. 1A is beam dyed, heat-set and weighs approximately 8.5 ounces per square yard. The preferred yarn utilized in making the warp knit fabric includes a textured 150/34 polyester yarn, type 56 in bars 1 and 3 and whereas bar 2 utilizes a 1,000/192 type Hoechst-/Celanese 785 multifilament non-textured yarn having a denier of 1,000 with a filament count of 74. The tenacity is 8.8 grams per denier (g/d) of the multifilament yarn and it has a breaking load of 19.4 pounds at 14% elongation.

Figure 6:
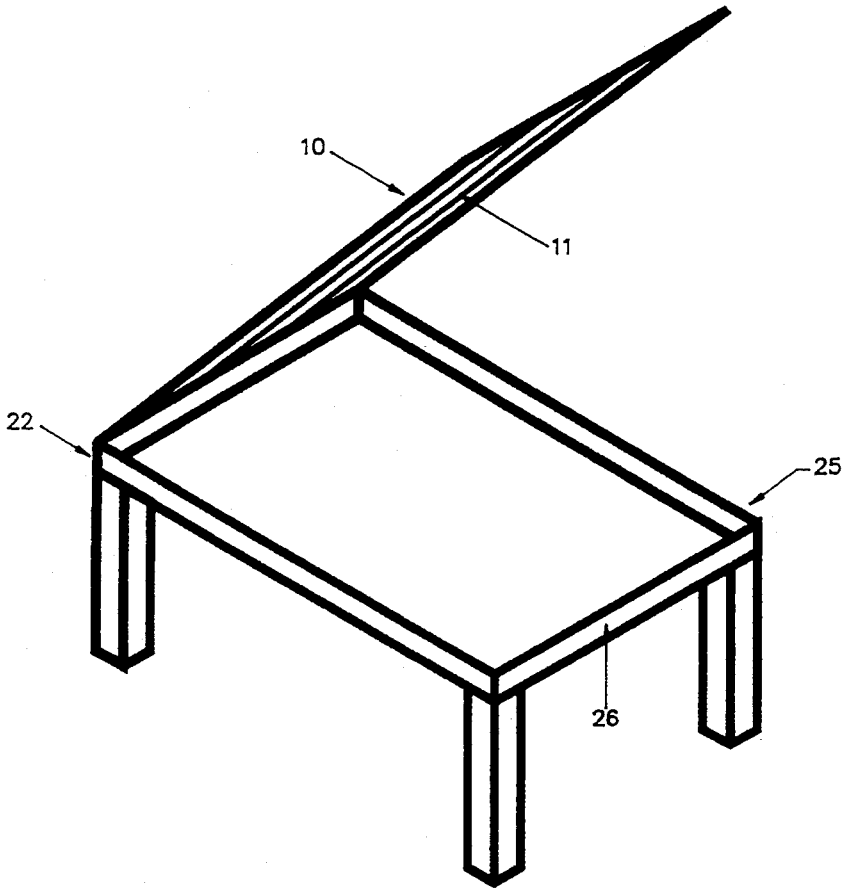
FIG. 6 shows a portion of a sofa frame with the decking material attached only on one side.

In use, the preferred method of decking comprises attaching a desirable width section of the above prepared decking suspension fabric to one end of a sofa frame as shown in FIG. 6 with the high denier polyester multifilament, non-textured yarn facing downwardly. The fabric is then tensioned by manually pulling it towards the opposite end of the frame where it is then attached by staples or the like under tension. As would be understood the polyester multifilament yarns are in horizontal or longitudinal alignment, parallel to the longitudinal axis of the sofa frame.

DETAILED DESCRIPTION OF THE DRAWINGS

For a better understanding of the invention and its use, turning now to the drawings, decking fabric 10 as shown in FIG. 1A is in roll form which may be for example, thirty inches wide and sixty feet in length. Decking fabric 10 comprises a warp knit fabric formed on a conventional 40 gauge Raschel warp knit knitting machine employing three knitting bars. Fabric 10 was formed with 150/34 textured polyester yarn on bars 1 and 3 and with 1,000/192 non-textured, multifilament polyester yarn on bar 2. As would be understood, bar 2 employs a polyester yarn having a denier over five times greater than the yarn deniers on bars 1 and 3. As shown in FIG. 1A, multifilament yarn 11 after knitting is exposed on only one surface in the warp direction of fabric 10 to form a short rib while the side of the fabric 10 opposite the rib remains smooth and regular, as is particularly illustrated in FIGS. 4 and 5. In use, exposed yarn 11 is positioned on the bottom surface of fabric 10 as seen in FIG. 6. Multifilament yarn 11 may consists of, for example 74 filaments. This yarn is of the high tenacity type having a grams per denier of 8.8 and a breaking load of 19.4 pounds at 14% elongation, making it strong and durable for its intended purpose in fabric 10. FIG. 1B is provided to show the relative placement of the 1,000 denier yarn 11 therein and is not intended as a complete representation of the fabric or the stitch pattern used as seen in FIG. 1C.

Yarn 12 as shown in FIGS. 1A, 1B and 1C comprises a much thinner denier polyester yarn which may be for example 150 denier. Various warp knit stitches can be utilized to knit heavy denier yarn 11 into the fabric such as seen in FIG. 1C which utilizes a full stitch on bars 1 and 3 and a 1-in, 3-out stitch for bar 2.

Figure 1D:
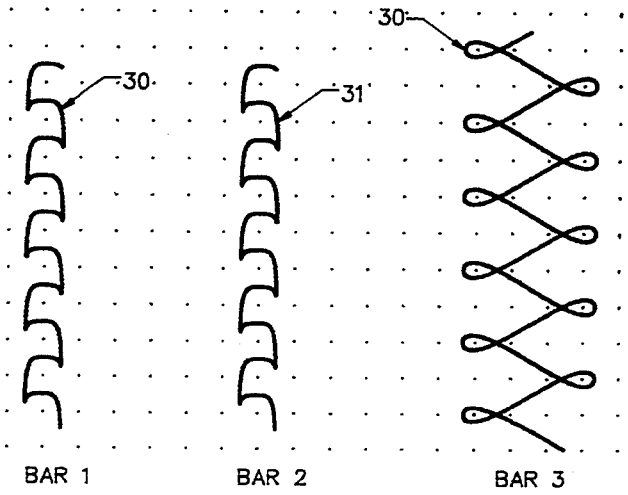
FIG. 1D provides yet another warp knit stitch pattern.

Another warp knit stitch pattern is shown in FIG. 1D which utilizes a 1/150 textured polyester yarn 30 in bars 1 and 3 and a 1000 denier non-textured multifilament yarn 31 on bar 2.

Figure 2:
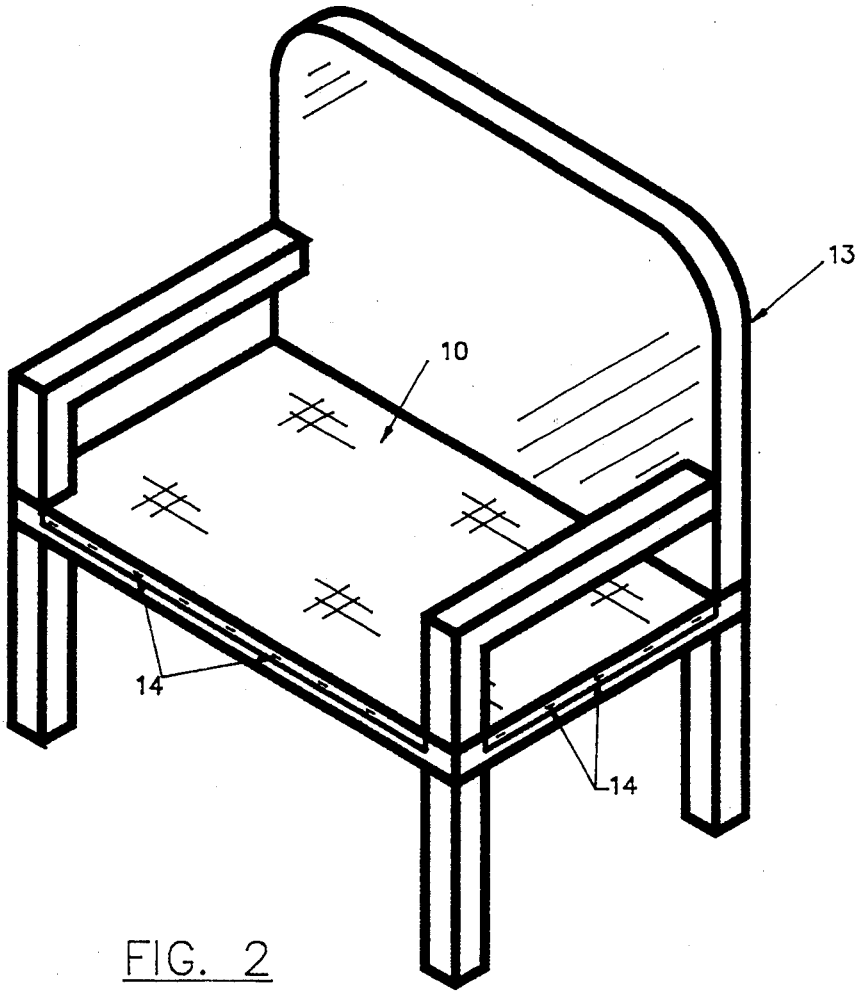
FIG. 2 illustrates a conventional sofa frame with the decking material attached.

In FIG. 2 furniture frame 13 is shown which utilizes decking fabric 10 thereon. Decking suspension fabric 10 is affixed to sofa frame 13 by staples 14 and is tensioned to support cushions thereon and is sufficient strength to maintain adults sitting thereon with multifilament yarn 11 on the underneath side (not shown).

Figures 3A, 3B:
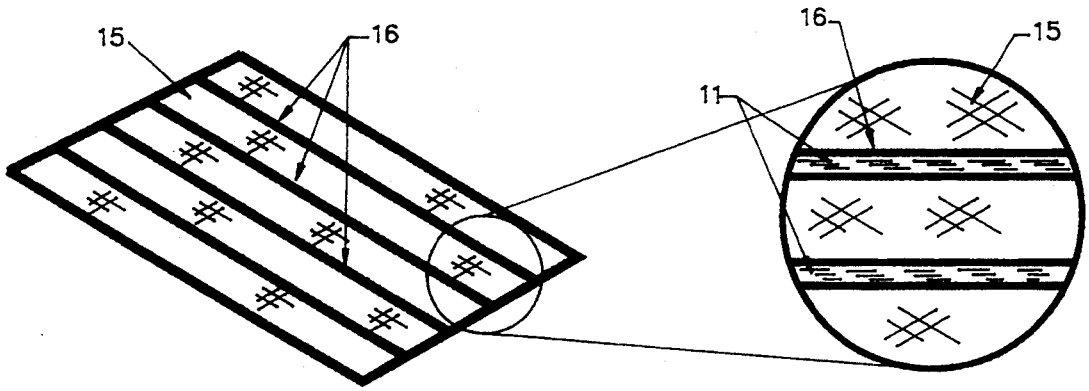
FIG. 3A shows yet another embodiment of the decking material.
FIG. 3B illustrates a close-up view of a section of the decking material of FIG. 3A.

In another embodiment of a decking suspension fabric, woven decking fabric 15 in FIG. 3A provides a second embodiment which comprises a conventional woven fabric base which may be for example formed from a 150 denier polyester yarn or otherwise and includes a series of parallel rows 16 of a conventional straight sewing stitch which employs a high tenacity, high denier polyester yarn such as a multifilament yarn 11 as shown in FIGS. 1A and 1B. A conventional sewing machine is used to make the straight stitch shown in FIGS. 3A and 3B. It has been found that by using a conventional sewing stitch and high denier, high tenacity polyester yarn 11, decking fabric 15 will have extremely high durability and strength. However, fabric 15 may have somewhat less resiliency than fabric 10 of FIG. 1A which has been warp knit.

Fabric 15 is first woven with relatively low (150–200 denier yarn) as contrasted with the high denier (1,000 denier) yarn 11 sewn as rows 16. Rows 16 may be preferrably spaced at one-eighth to one-quarter inch intervals to provide the best strength but may be spaced further apart such as at one inch intervals under certain circumstances. The straight stitch shown for rows 16 are made on a conventional sewing machine and may have a width of approximately one-sixteenth of an inch but other widths as desired may be used.

Figure 4:
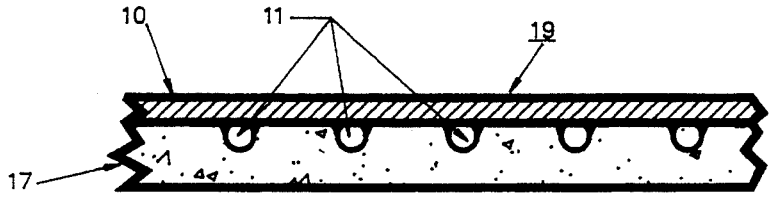
FIG. 4 shows a urethane foam layer quilted beneath the decking suspension material as seen in FIG. 1A.
Figure 5:
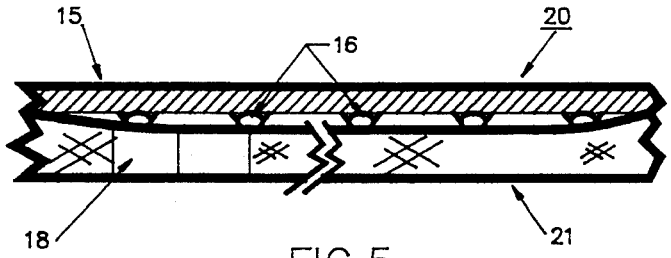
FIG. 5 shows yet another laminate formed from the decking material of FIG. 3A but with a needle punched mat layer affixed thereto.

In FIG. 4 a laminated decking suspension material 19 is presented whereby fabric 10 is attached to a thin polyurethane foam layer 17 such as by an adhesive or quilting. Polyurethane foam layer 17 will provide a soft backing for fabric 10 and will cover polyester fibers 11 therebetween. In FIG. 5 yet another laminated decking material 20 is shown whereby fabric 15 as seen in FIG. 3A has been affixed to a needle punched mat 18 or a woven polypropylene fabric 21. Mat 18 is formed from a randomly arranged, non-woven mat of synthetic fibers such as the polyester or nylon types and has been needle punched as known in the art for stability.

The method of attaching decking material 10 comprises attaching it to end 22 of wooden sofa frame 25 as shown in FIG. 6. Fabric 10 is positioned on frame 25 with the exposed high tenacity, high denier yarn 11 facing downwardly. As would be understood, fabric 10 has been cut to the approximate size of frame 25 and is manually pulled towards end 26 where it is then affixed thereto by staples or the like.

As would be understood by those skilled in the art, circular knit, double knit, woven and other fabric combinations can be employed and the illustrations and examples provided herein are for explanatory purposes and are not intended to limit the scope of the appended claims.

We claim:

1. A knit decking suspension fabric comprising: a plurality of polymeric yarns, said yarns comprising textured warp and weft knitted yarns and a non-textured multifilament warp yam, said multifilament yarn having a denier larger than said textured warp and weft knitted yarns, said multifilament yarn knitted in and exposed on only one surface of said fabric to form a series of parallel ribs in the warp direction, said multifilament yarn being unexposed on the opposite surface, said opposite surface being relatively smooth and regular.

2. A knit decking suspension fabric as claimed in claim 1 wherein said textured yarn has a denier in the 50 to 200 range.

3. A knit decking suspension fabric as claimed in claim 1 wherein said multifilament yarn has a denier in the 700 to 1,700 range.

4. A knit decking suspension fabric as claimed in claim 1 wherein said textured yarn has a denier of 150.

5. A knit decking suspension fabric as claimed in claim 1 wherein said plurality of polymeric yarn comprises a trio of yarns, said trio of yarns comprising a pair of 150 denier textured yarns and a 1,000 denier multifilament yarn.

6. A warp knit decking suspension fabric comprising: a plurality of bar yarns, said plurality of bar yarns comprising a pair of textured polymeric yarns having a relatively small denier, and a third bar yarn comprising a non-textured multifilament yarn, said multifilament yarn having a denier larger than said pair of textured polymeric yarns, said multifilament yarn knitted in said fabric and forming a series of raised ribs with said multifilament yarn exposed along only one surface of said fabric, said multifilament yarn being unexposed on the opposite surface of the fabric, said multifilament yarn positioned in the warp direction of said fabric, said opposite surface of said fabric being relatively smooth and regular.

7. A warp knit decking suspension fabric as claimed in claim 6 wherein said pair of textured polymeric yarns are knit with a full thread stitch and said multifilament yarn comprises a 1-in, 3-out stitch.

8. A warp knit decking suspension fabric as claimed in claim 7 wherein said multifilament yarn comprises a yarn having a 1,000 denier.

9. A decking suspension material comprising: a planar base, a plurality of heavy denier non-textured polymeric yarns, said heavier denier yarns sewn into only one surface of said base, said sewn-in yarns being exposed and forming raised parallel ribs therealong, said opposite surface of said base being relatively smooth and regular.

10. The decking suspension material as claimed in claim 9 wherein said base comprises a textile fabric.

11. The decking suspension material as claimed in claim 9 wherein said heavy denier yarn comprises a denier in the range of from 100 to 1,000.

12. The decking suspension material as claimed in claim 9 wherein said heavy denier yarns are sewn in rows approximately $\frac{1}{4}$ inch apart.

13. The decking suspension material as claimed in claim 9 wherein said heavy denier yarns are sewn in parallel rows $\frac{1}{8}$ to 1 inch apart.

14. The decking suspension material as claimed in claim 9 and including a foam layer, said foam layer attached to said base.

15. The decking suspension material as claimed in claim 9 wherein said heavy denier yarns are sewn in rows approximately 1/16 of an inch wide on said base.

16. The decking suspension material as claimed in claim 14 wherein said foam layer is attached to the bottom surface of said base to thereby cover said heavy denier yarns.

17. The decking suspension material as claimed in claim 9 wherein said base is formed from relatively light denier yarns.

18. The decking suspension material as claimed in claim 9 and including a backing layer, said backing layer attached to said base.

19. The decking suspension material as claimed in claim 18 wherein said backing layer comprises a polypropylene fabric.

20. The decking suspension material as claimed in claim 18 wherein said backing layer comprises a needle punched mat.

* * * * *